US010633163B1

(12) United States Patent
Arnold

(10) Patent No.: US 10,633,163 B1
(45) Date of Patent: Apr. 28, 2020

(54) TRANSPORT CONTAINER FOR RADIOACTIVE MATERIAL

(71) Applicant: William M. Arnold, Abingdon, VA (US)

(72) Inventor: William M. Arnold, Abingdon, VA (US)

( * ) Notice: Subject to any disclaimer, the term of this patent is extended or adjusted under 35 U.S.C. 154(b) by 0 days.

(21) Appl. No.: 16/350,846

(22) Filed: Jan. 23, 2019

Related U.S. Application Data

(60) Provisional application No. 62/709,632, filed on Jan. 24, 2018.

(51) Int. Cl.
*B65D 81/07* (2006.01)
*B65D 85/00* (2006.01)

(52) U.S. Cl.
CPC ..... *B65D 81/07* (2013.01); *B65D 85/70* (2013.01)

(58) Field of Classification Search
CPC ..... B65D 85/70; B65D 81/07; G21F 5/00; G21F 5/005
USPC ..... 206/521–594; 250/506.1, 515.1
See application file for complete search history.

(56) References Cited

U.S. PATENT DOCUMENTS 2,700,458 A * 1/1955 Brown ..... B65D 81/07 206/319
3,265,200 A * 8/1966 Omer ..... B65D 85/38 206/418
4,560,069 A * 12/1985 Simon ..... B65D 5/509 206/523
4,588,088 A * 5/1986 Allen ..... G21F 5/00 206/524
4,872,563 A * 10/1989 Warder ..... B65D 17/402 53/471
5,443,177 A * 8/1995 Crayne ..... B09B 3/0025 220/62.15
6,389,093 B1 * 5/2002 Gluschke ..... G21F 5/10 376/272
6,438,190 B2 * 8/2002 Gluschke ..... G21F 5/005 376/260
6,489,623 B1 * 12/2002 Peters ..... G21F 5/008 250/506.1
6,727,510 B2 * 4/2004 Matsunaga ..... G21F 5/12 105/358
6,785,355 B2 * 8/2004 Georgii ..... B28B 23/00 376/272
8,049,194 B2 * 11/2011 Nicholson ..... G21F 5/008 250/507.1

(Continued)

*Primary Examiner* — Chun Hoi Cheung

(57) ABSTRACT

A transport container for radioactive and other dangerous materials and comprising an outer impact protective steel container in which an inner container is mounted, and in which an impact absorbing cradle is positioned, wherein the cradle is structured to carry a materials containment vessel and comprises a supporting band structure formed around a vertical axis of the cradle, wherein the cradle further has a plurality of wire loops each of which is configured with an inner vertical leg, and outer vertical leg spaced radially outwardly from said inner vertical leg, a top span connecting the legs at their upper ends, and a bottom span connecting the legs at their lower ends, wherein the inner vertical legs are affixed to an outer surface of the band structure within which a containment vessel is mounted, wherein each inner and outer leg pair and an axis of the cradle lie in a common radial plane and whereby the loops are spaced peripherally around the band structure.

8 Claims, 6 Drawing Sheets

(56) References Cited

U.S. PATENT DOCUMENTS

| | | | | |
|---|---|---|---|---|
| 9,396,824 | B2 * | 7/2016 | Agace | G21F 5/005 |
| 9,437,331 | B2 * | 9/2016 | Cordaro | H02J 50/12 |
| 10,515,730 | B2 * | 12/2019 | Singh | G21F 5/12 |
| 2002/0195575 | A1 * | 12/2002 | Martin | G21F 5/018<br>250/506.1 |
| 2012/0037632 | A1 * | 2/2012 | Singh | G21F 5/005<br>220/367.1 |
| 2016/0196887 | A1 * | 7/2016 | Singh | G21F 5/008<br>220/592.01 |

* cited by examiner

TRANSPORT CONTAINER FOR RADIOACTIVE MATERIAL

This application claims benefit of Applicant's Provisional Application Ser. No. 62/709,632 filed Jan. 24, 2018 of same title.

1. FIELD

The present invention resides in a container structure having special utility for the storage and or shipment of fluid or solid materials which may be of a toxic or otherwise hazardous nature including radioactive materials and which are contained in special vessels which must not be impacted by damaging forces and caused to leak such materials. The present invention especially concerns unique construction of a "flex cage" supporting said vessels in a substantially upright axial posture even though the radially outer shell structure of the container is struck by heavy damaging forces. The present container is further constructed to allow repeated reuse of the container even though it is subjected to rough treatment which normally would puncture or otherwise seriously damage vessels such as aye presently in use for containing such materials.

Of great concern to the hazardous material storage, transporter, or user, to Federal Regulators and to the environment is the relative ease with which such conventional containers can be damaged in accidents, often resulting in leaks and spills of toxic or otherwise dangerous chemicals. Such incidents also occur where containers are moved about and stacked or loaded or unloaded onto or from vehicles by fork-lift trucks or the like. During such operations, puncture or other substantial damage to the container often occurs. As a result of these experiences, Federal Regulations now substantially restrict the reuse of chemical containers and costly disposal thereof is the necessary consequence.

For an even more onerous use of such containers there has been a need for a new generation of shipping containers for the nuclear industry for many years in that the presently utilized fleet of shipping containers is based on 40 year old technology and many of them no longer meet the current regulations such as those regulations recited for packages in 10 CFR 71.71 et seq. Due to recent changes in the regulations many older packages are obsolete due to their inability to successfully pass new more stringent requirements. Several of the staple containers are being removed as options for transport and the industry is in need of a cost effective, safe and reliable alternative. Such containers or packages which find utility for many applications but which may be unsuited for transporting, e.g., uranium dioxide, uranyl nitrate hex hydrate, U233, PU/$PuO_2$/MOX and various neutron sources, are described in U.S. Pat. Nos. 5,595,319; 2,148,278; 2,575,283; 2,596,244; 3,197,066; 4,184,609; 4,712,711; 4,986,436; and 4,989,447.

SUMMARY OF THE INVENTION

A transport container for radioactive and other dangerous materials, wherein the container comprises a steel wall formed to provide a materials containment cavity, an impact absorbing flex cradle positioned in the said cavity, wherein the said flex cradle is structured with a circular shaped band structure formed around a vertical axis of the cradle, wherein the cradle further has a plurality of wire loops each of which is configured with an inner vertical leg, and outer vertical leg spaced radially outwardly from the inner vertical leg, a top span connecting the legs at their upper ends, and a bottom span connecting the legs at their lower ends, wherein the inner vertical legs are affixed to an outer surface of the band structure whereby each of the inner and outer legs and the flex cradle axis lie in a common radial plane, wherein the said loops are spaced peripherally around the band structure, and wherein the band structure is configured and dimensioned to support a materials container vessel.

The present container construction markedly improves the strength and structural integrity of hazardous material containers and makes them reusable. In this regard, the present container can utilize a conventional ring ribbed 55 gal. drum or the like to provide an inner shell which can be slid down into an outer protective shell, wherein said inner shell contains the present flex cage.

BRIEF DESCRIPTION OF THE DRAWINGS

The accompanying drawings illustrate preferred embodiments of the present invention, wherein the various figures are not drawn to scale or in consistent proportions.

DETAILED DESCRIPTION OF THE DRAWINGS

Figure 1:
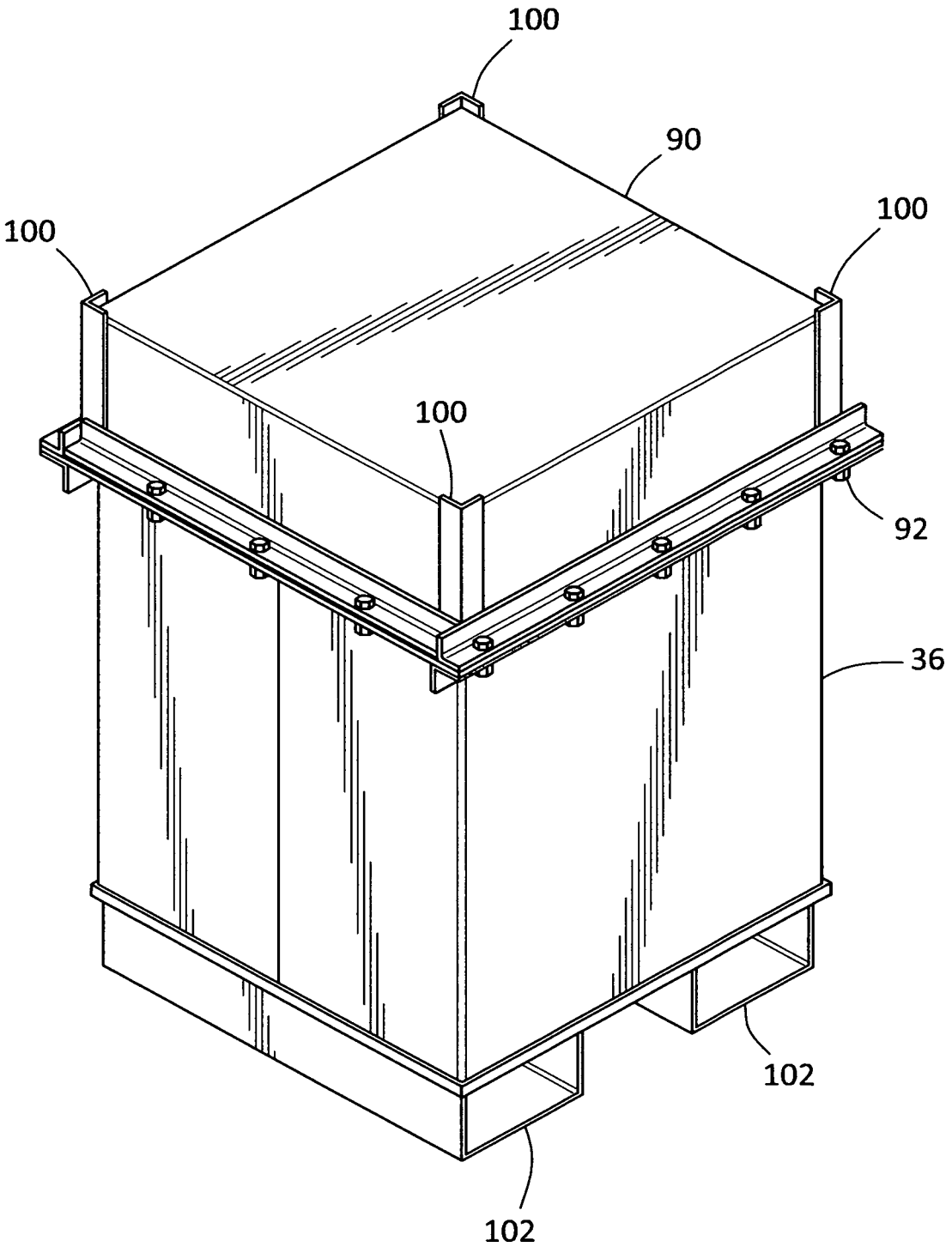
FIG. 1 is an isometric view of the present container with the top cover in place thereon.
Figure 2:
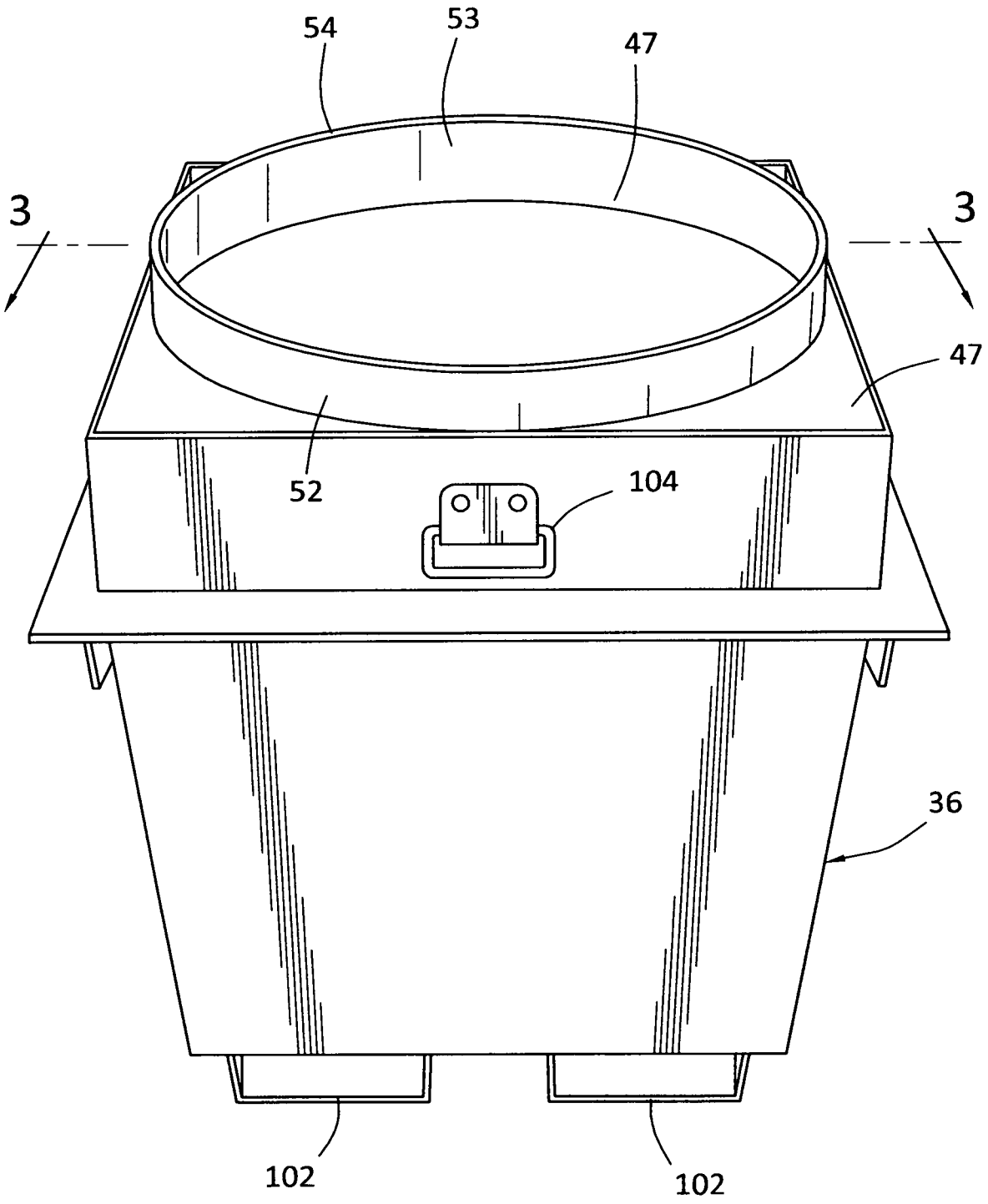
FIG. 2 is a view as in FIG. 1 with the top cover removed showing the granular innulation and shock absorbing fill material.
Figure 3:
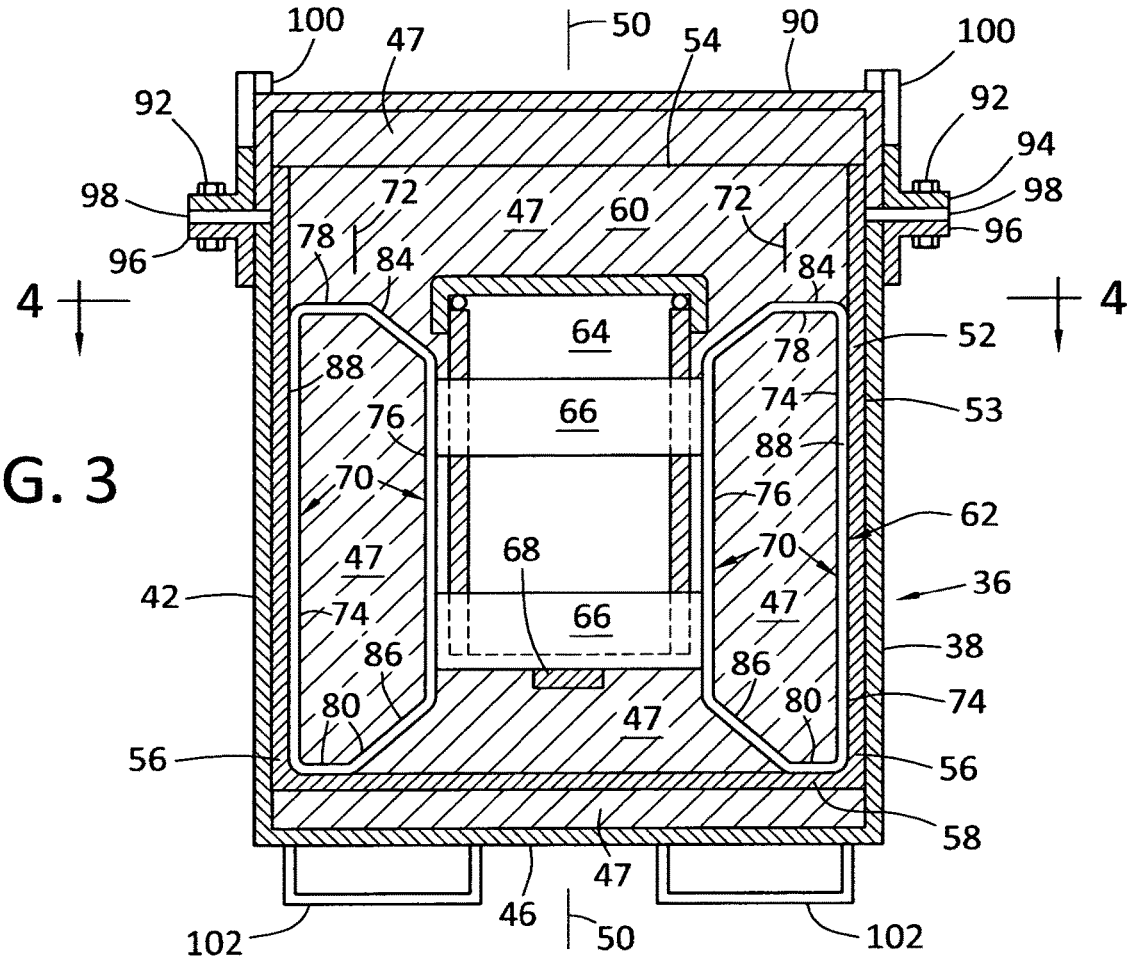
FIG. 3 is a cross-sectional view taken along line 3-3 in FIG. 2 and showing the present "flex cage" (radioactive material cannister) in place within the inner shell and with the top cover bolted (92) through angle iron flanges 94 and 96 and gasket 98.
Figure 4:
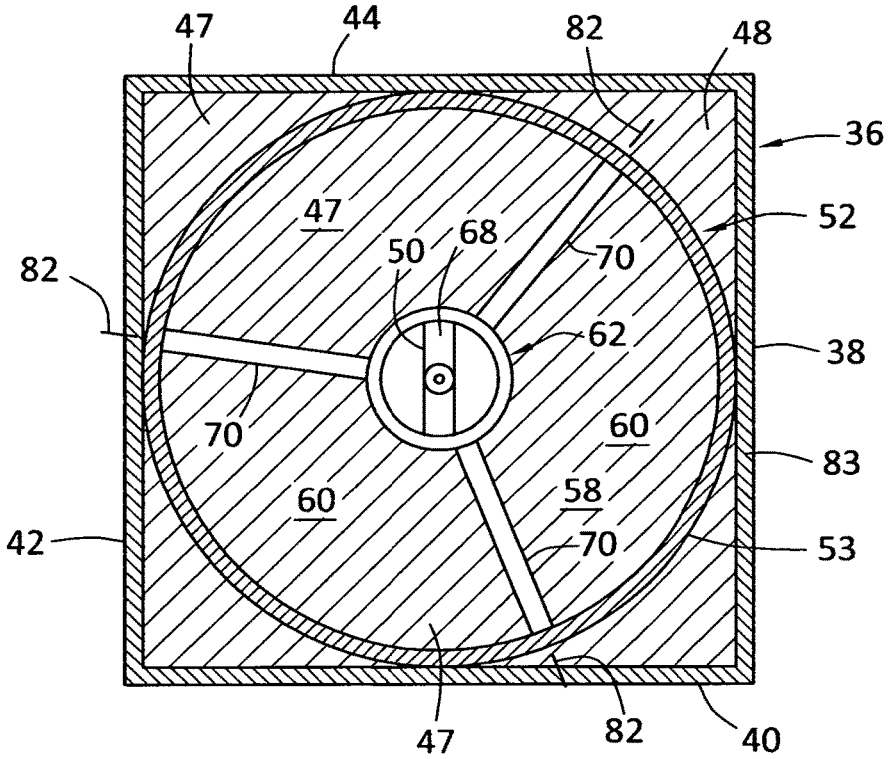
FIG. 4 is a cross-sectional view taken along line 4-4 in FIG. 3 without the vessel 64 and with reduced diameter cradle.
Figure 5:
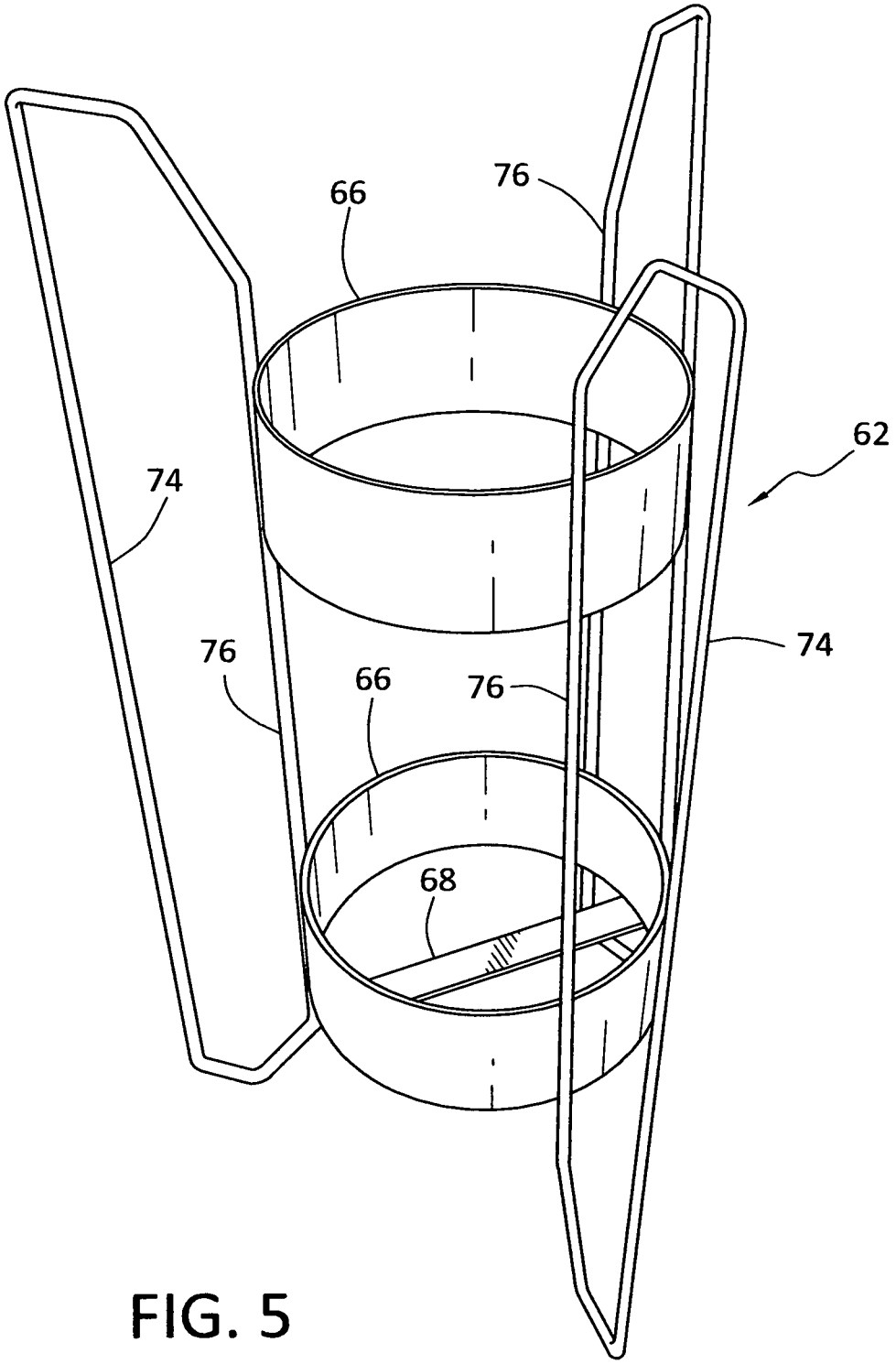
FIG. 5 is an isometric side view of a preferred configuration of the flex cage.
Figure 6:
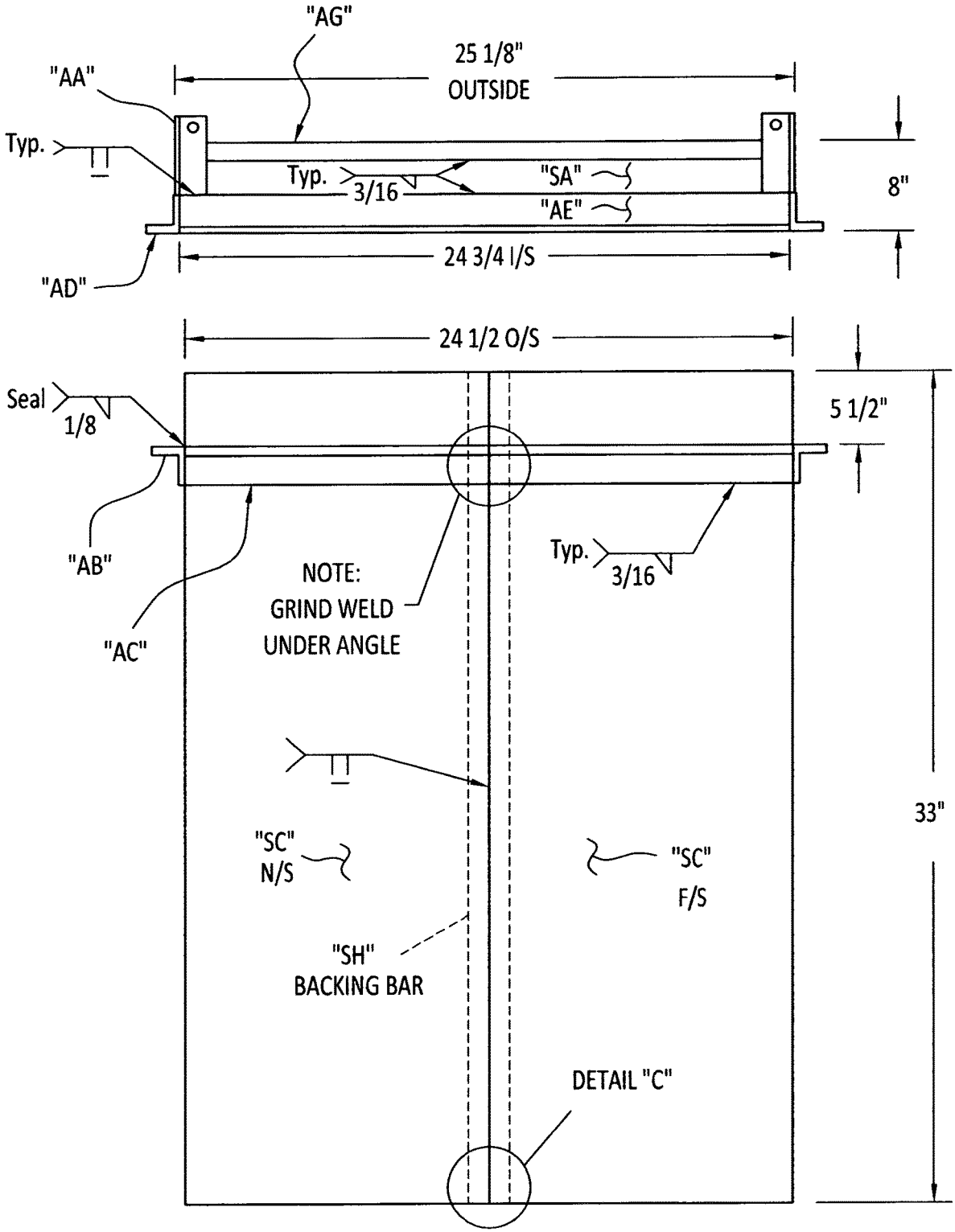
FIG. 6 shows typical structure and dimensions for one preferred outer shell.
Figure 7:
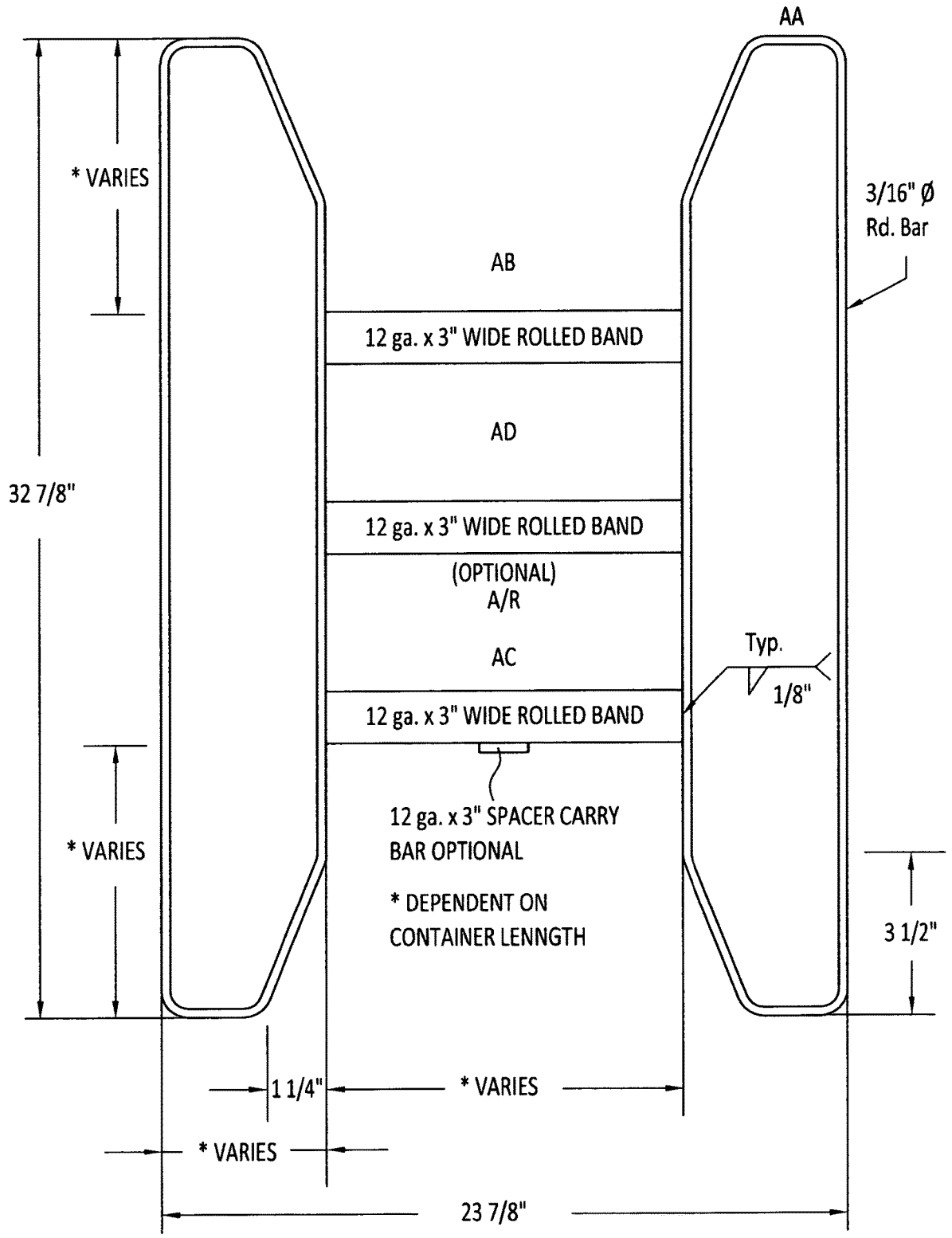
FIG. 7 shows a typical structure and dimensions for a preferred flex cradle.

In one preferred embodiment of the present invention, the container is of steel construction and comprises an outer steel shell 36 comprised of four walls 38, 40, 42, 44 a floor 46 and forming a substantially square in cross-section first cavity 48 having a longitudinal axis 50, and a top cover 90. An inner shell 52 is comprised of a circular in cross-section wall 53 having a top edge 54 and a bottom edge 56, and a floor 58 affixed to bottom edge 56 and is nested within first cavity 48 with floor 58 of the inner shell positioned adjacent to floor 46 of the outer shell or cushioning/insulation material 47 thereon, and with wall 53 of the inner shell positioned adjacent to four walls of the outer shell and forming a second cavity 60 formed around longitudinal axis 50.

A flex cage 62 is nested within the second cavity for carrying a material containing vessel 64, wherein the flex cage comprises a circumferentially closed band structure 66 formed around longitudinal axis 50 and having a bottom stop plate 68. This cage further comprises a series, (e.g. 3-10) of substantially rectangular shaped semi-flexible wire loops 70 preferably substantially equally spaced circumferentially around the perimeter 83 of inner shell 52, wherein each loop has a longitudinal axis 72 and a pair of longitudinally extending radially outer 74 and radially inner 76 legs, each of said legs having an upper end 78 and a lower end 80, wherein said legs lie in a common plane 82 which passes through longitudinal axis 50, and wherein the legs are connected at their upper and lower ends by generally laterally extending portions 84 and 86 respectively of the wire, and wherein the radially outer legs are positioned adjacent to an inner wall surface 88 of said inner shell, and wherein a top cover 90 is provided for bolting as through flanges 94, 96, and sealing gasket 98 other insulating or cushioning materials such as to the walls of the outer shell.

The cushioning/insulation 47 material preferably is granular vermiculite but can be of other known cushioning materials such as glass wool, synthetic foamed or granular or the like polyurethane, polyolefin, polyester, polyamide, polycarbonate, or rubber (natural or synthetic). Container stacking guides 100, forklift fork channels 102, and cover lift handles 104 preferably are provided.

The invention has been described in detail with particular reference to preferred embodiments thereof, but it will be understood that variations and modifications will be effected within the spirit and scope of the invention.

I claim:

1. A transport container structure for radioactive and other dangerous materials, said container structure comprising an outer wall forming a lower body section open at a top thereof, a separate upper lid section, said lower body section being formed to provide a first cavity, said lid section being formed to provide a closure to said open top of said body section, mating connection flanges on said sections, an inner materials containment structure mounted within said first cavity and being formed to provide a second cavity, an impact absorbing flex cradle positioned in said second cavity, said flex cradle being structured with a substantially circular shaped band structure formed around a vertical axis of said flex cradle for supporting a materials containment vessel, said flex cradle further having a plurality of wire loops each of which is configured with an inner vertical leg, and outer vertical leg spaced radially outwardly from said inner vertical leg, a top span connecting said legs at their upper ends, and a bottom span connecting said legs at their lower ends, wherein said inner vertical legs are affixed to an outer surface of said band structure whereby each said inner and outer legs and said cradle axis lie in a common radial plane and whereby said loops are spaced peripherally around said band structure.

2. The container structure of claim 1 wherein from 3 to 10 wire loops are provided.

3. The container structure of claim 2 wherein said loops are comprised of steel wire having a diameter of from about 1/32 in. to about 1/4 in.

4. The container structure of claim 3 wherein said outer wall is substantially square in cross-section and said inner materials containment structure is a 55 gallon drum slidingly fitted down into said first cavity.

5. The container structure of claim 4 wherein a materials containing vessel is mounted within said band structure.

6. The container structure of claim 5 wherein all vacant portion of said second cavity is filled with impact cushioning.

7. The container of claim 6 wherein all vacant portions of said first cavity and said upper lid structure are filled with impact cushioning.

8. The container of claim 1 wherein the vertical outer legs are in sliding contact with an inner surface of said outer wall of said lower body section.

* * * * *